US009062429B2

(12) United States Patent
Lee et al.

(10) Patent No.: US 9,062,429 B2
(45) Date of Patent: Jun. 23, 2015

(54) SHALLOW WATER JACKET INSTALLATION METHOD

(71) Applicants: James Lee, Tianjin (CN); Wen Jun Zhong, Tianjin (CN); Han Jun Yin, Tianjin (CN); Xiao Wei Zhang, Tianjin (CN)

(72) Inventors: James Lee, Tianjin (CN); Wen Jun Zhong, Tianjin (CN); Han Jun Yin, Tianjin (CN); Xiao Wei Zhang, Tianjin (CN)

( * ) Notice: Subject to any disclaimer, the term of this patent is extended or adjusted under 35 U.S.C. 154(b) by 0 days.

(21) Appl. No.: 13/966,115

(22) Filed: Aug. 13, 2013

(65) Prior Publication Data

US 2015/0050089 A1 Feb. 19, 2015

(51) Int. Cl.

| | |
|---|---|
| ***B63B 43/14*** | (2006.01) |
| ***E02B 17/02*** | (2006.01) |
| ***E02B 17/00*** | (2006.01) |

(52) U.S. Cl.

CPC ..... *E02B 17/02* (2013.01); *E02B 17/0034* (2013.01); *E02B 2017/0039* (2013.01); *E02B 2017/0047* (2013.01)

(58) Field of Classification Search

CPC ..... B63B 35/285; B63B 43/14; B63C 7/10; E02B 2017/0039

USPC ..... 405/200, 203, 205, 206, 209, 224, 227, 405/228

See application file for complete search history.

(56) References Cited

U.S. PATENT DOCUMENTS

| | | | | | |
|---|---|---|---|---|---|
| 3,054,267 | A | * | 9/1962 | Alcorn et al. | 405/209 |
| 4,165,196 | A | * | 8/1979 | Serrano | 405/205 |
| 4,252,468 | A | * | 2/1981 | Blight | 405/204 |
| 4,702,648 | A | * | 10/1987 | Stageboe et al. | 405/224 |
| 4,729,695 | A | * | 3/1988 | Silvestri | 405/204 |
| 4,927,296 | A | * | 5/1990 | Kaldenbach | 405/206 |
| 5,088,858 | A | * | 2/1992 | Massoudi | 405/203 |
| 5,975,806 | A | * | 11/1999 | Delamatyr | 405/198 |
| 6,155,748 | A | * | 12/2000 | Allen et al. | 405/195.1 |
| 6,269,761 | B1 | * | 8/2001 | Abraham et al. | 114/123 |
| 6,547,491 | B1 | * | 4/2003 | Haney | 405/195.1 |
| 7,033,115 | B2 | | 4/2006 | Huang | |
| 8,534,958 | B2 | * | 9/2013 | Reichel et al. | 405/205 |
| 2011/0129304 | A1 | * | 6/2011 | Wu et al. | 405/224 |

FOREIGN PATENT DOCUMENTS

| | | | | | |
|---|---|---|---|---|---|
| JP | 58110724 | A | * | 7/1983 | E02D 23/02 |

* cited by examiner

*Primary Examiner* — Benjamin Fiorello

(74) *Attorney, Agent, or Firm* — Tim Liu; Theodore Lapus

(57) ABSTRACT

A new jacket installation method utilizes inflatable buoyancy members for shallow water jacket installation. Two types of inflatable buoyancy members are introduced: 1) the first type is designed to produce a large water plane area in order to improve the jacket floating stability when it is afloat; 2) the second type is designed to produce net buoyancy when they are submerged under water, This new installation method is able to use a small size crane vessel, with lifting capacity less than the weight of the jacket to be installed, for a large and heavy shallow water jacket.

35 Claims, 15 Drawing Sheets

SHALLOW WATER JACKET INSTALLATION METHOD

FIELD OF THE INVENTION

The disclosure relates generally to an improved method for installing offshore fixed platforms, more particularly for shallow water jacket installation applications.

BACKGROUND OF THE INVENTION

An offshore platform is generally composed of two sections: 1) a substructure such as a jacket for a fixed platform, and 2) a superstructure such as a deck to be installed on the top of a substructure.

A deepwater substructure, deeper than 60 meters (about 200 ft) in water depth, of a fixed platform is normally fabricated as a single unit with battered leg onshore in a horizontal orientation and then skidded onto a transport vessel or a launch vessel, towed to the installation site in a horizontal orientation, launched or lifted off from the vessel, and placed at the seabed before upending/ballasting of the jacket to a vertical position. Finally, foundation piles are driven to fix the jacket with the seabed by grouting or welding.

A shallow water substructure, less than 60 meters (about 200 ft) in water depth, of a fixed platform is normally fabricated as a single unit with vertical legs onshore in a vertical orientation and then skidded onto a transport vessel or a semi-submersible vessel, towed to the installation site in a vertical orientation, lifted off the transport vessel deck, or lifted off the semi-submersible vessel deck when it is submerged to a design draft, and placed at the seabed in a vertical orientation throughout the installation operations. Finally, foundation piles are driven to fix the jacket with the seabed by welding between foundation piles and jacket leg tops.

For a typical shallow water jacket configuration, especially a large sized one, it is very difficult to gain sufficient net buoyancy. Therefore, a large crane installation with a lifting capacity larger than the weight of the jacket has to be utilized to lift the jacket as a whole off the transport vessel deck, or the semi-submersible vessel deck, and to place the jacket at the seabed.

In recent years, shallow water jackets get heavier and heavier because the associated deck weights also get heavier and heavier. In many cases, the jacket weights exceed the lifting capacity of available crane vessel(s) and alternative jacket installation methods have to be considered. One common alternative method is to launch the jacket. If the launching method is adopted, the jacket orientation on the transport vessel is usually changed to a horizontal orientation. In addition, it has to face two common challenges:

1. The jacket has to be a self afloat structure with necessary reserve buoyancy (usually >12%, defined as (submerged buoyancy−total weight)/submerged buoyancy %). In order to satisfy this requirement, a large number of steel-made buoyancy tanks have to be installed and connected to the jacket and to make this jacket even heavier. Ballast tanks and flooding/venting systems have to be designed in order to lower the jacket to seabed through ballasting operations. These buoyancy tanks have to be removed after the installation and transported back onshore at a considerable cost. Other costs include fabrication and installation of the buoyancy tanks and the design and fabrication of the ballast tanks. Another issue is that the weight of steel makes the steel-made buoyancy inefficient to produce net buoyancy and very costly for each ton of net buoyancy. For example, one ton steel used for making buoyancy tanks could typically produce 3-ton buoyancy. If deducting the steel weight, each ton of steel could produce only 2-ton net buoyancy. Adding other costs such as design, fabrication, flooding/venting system, welding to a jacket, offshore cutting to remove from the jacket, lifting and the use of a transport vessel for returning the tanks back, the total cost of using buoyancy tanks could be very high.

2. Due to the shallow water at the installation site, a launched jacket could easily hit the seabed during the launch operation. In such cases, the jacket is usually towed to a deeper water location, launched and wet towed from the launching site to the installation site. If the launching site is far away from the installation site, the cost associated with the wet tow could be high.

A heavy shallow water jacket could be launched in a vertical orientation. However, it would require larger reserve buoyancy (>20%) and the attached buoyancy tanks have to be placed at very low position, to pick up buoyancy immediately after the launch, which would impose extra difficulty for removing these buoyancy tanks because they would be all submerged after the launch.

Therefore there is a need for a shallow water jacket installation method that is more efficient in producing net buoyancy and cost effective.

SUMMARY OF THE INVENTION

An offshore jacket installation method using non-steel buoyancy tanks is disclosed. A special type of air bags, called launching air bags (SLAB), is utilized as buoyancy tanks to replace the steel buoyancy tanks. SLAB buoyancy tanks provide low cost net buoyancy in order to make a shallow water jacket self afloat with a sufficient bottom clearance with seabed.

The jacket installation method includes preparing a plurality of non-steel buoyancy tanks for the installation, installing the prepared non-steel buoyancy tanks on the jacket, injecting air into non-steel, buoyancy tanks to achieve a predetermined internal air pressure level, transporting the jacket to the installation site with a transportation apparatus, removing the jacket from the transportation apparatus to let the jacket becomes self afloat with positive reserve buoyancy, lowering the jacket to the seabed, releasing air from each non-steel buoyancy tank to reach another predetermined internal air pressure level, and removing non-steel buoyancy tanks from the jacket. All attached non-steel buoyancy tanks together should contribute a reserve buoyancy greater than 20% of the jacket total reserve buoyancy (combining the one contributed by non-steel buoyancy tanks with the others contributed by the jacket members) when it is in a self-floating condition.

BRIEF DESCRIPTION OF THE DRAWINGS

The drawings described herein are for illustrating purposes only of selected embodiments and not all possible implementations, and are not intended to limit the scope of the present disclosure. For a further understanding of the nature and objects of this disclosure reference should be made to the following description, taken in cornunetion with the accompanying drawings in which like parts are given like reference materials, and wherein.

DETAILED DESCRIPTION OF THE EMBODIMENTS

Ship building in sand beaches started in 1980's in Southern China. Builders place wood blocks on a sloped sand beach and start ship construction on the tops of these blocks with land cranes. When the construction is complete, a special type of air bags, Ship Launching Air Bags (SLAB), would be placed under the ship keel longitudinally between two rows of wood blocks. Injecting air to these SLABs, the ship should be lifted off the wood blocks. After the lifting operation, the wood blocks would be then removed off the ship keel. Once cutting holding lines, the ship will be launched toward the sea along with the rolling of these SLABs.

The ship launch using SLAB's method has been successfully deployed in China for quite some time already. Recently, the application of SLAB has expanded to other areas, such as ship salvage, a floatation tool for the transportation of a large concrete structure for a bridge. In these applications, "ears" used for tying-up with other structures are added on the middle section surface of the SLAB. These "ears" usually use the same material such as nature rubber and polyester nets and experience a vulcanization process together with the middle section in order to be bonded together. Nowadays, the SLABs have become a mature and off shelf product in China shipbuilding industry with excellent characteristics, such as light in weight, durable, scratch resistant, and tolerant of high internal pressure, etc.

Figure 1A:
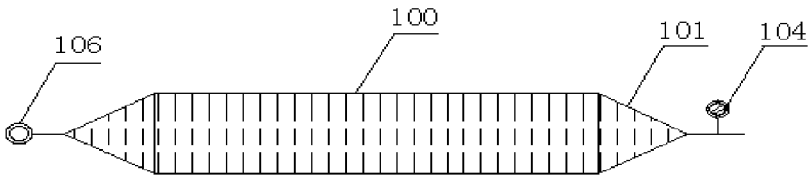
FIG. 1A (Prior Art)
FIG. 1A is a side view of a conventional Ship Launching Air Bag.

A standard SLAB 100 is made of a tubular middle section and two cone sections at the ends. FIG. 1A illustrates one embodiment of a standard SLAB 100. As shown in FIG. 1A, a standard Ship Launching Air Bag 100 is divided into three sections: a front cone section 101, a middle section and a back cone section. The length of the middle section varies for each application.

Figure 1B:
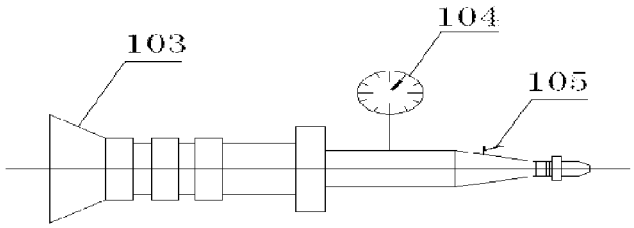
FIG. 1B (Prior Art)
FIG. 1B is a side view a front end cone structure of the conventional SLAB in FIG. 1A.

As shown FIG. 1B, the front cone section 101 comprises a steel cone structure 103 covered with rubber layers with several attachments such as an air valve 105 for air inlet and exit, and an air pressure meter 104. The back end steel cone is similar to the front cone section with a steel ring 106 attached at the end for handling the SLAB 100. The back end cone section does not have the pressure meter or the air valve.

The middle section and the surfaces of the two end sections are made of nature rubber mixed with several layers of polyester nets. The cone structure with nature rubber/polyester net layer is totally bonded with the steel cone structure 103 through a vulcanized process. During the SLAB 100 assembling process, the air bag is put into a sealed container with high temperature for a predetermined duration with a vulcanization process to make the rubber layers tightly bonded with the cone steel surfaces at both ends and the rubber bonded with layers of polyester nets at the middle section and the two end sections.

Figure 1C:
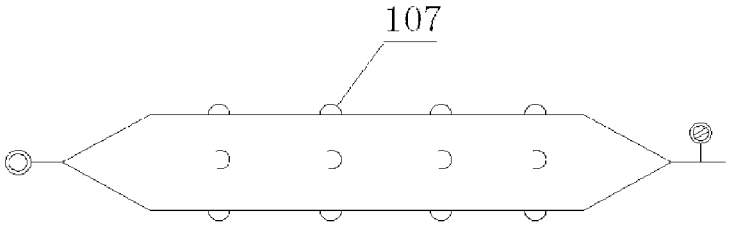
FIG. 1C (Prior Art)
FIG. 1C is a side view of a conventional SLAB with "ears"

FIG. 1C is a side view of a SLAB 100 used as a buoyancy tank in offshore jacket installation. Several rows of "ears" 107 are circularly arranged at the surface of SLAB 100 middle section. These ears are utilized for tying up the SLAB 100 with other SLABs 100 or with other jacket structural members.

Figure 2A:
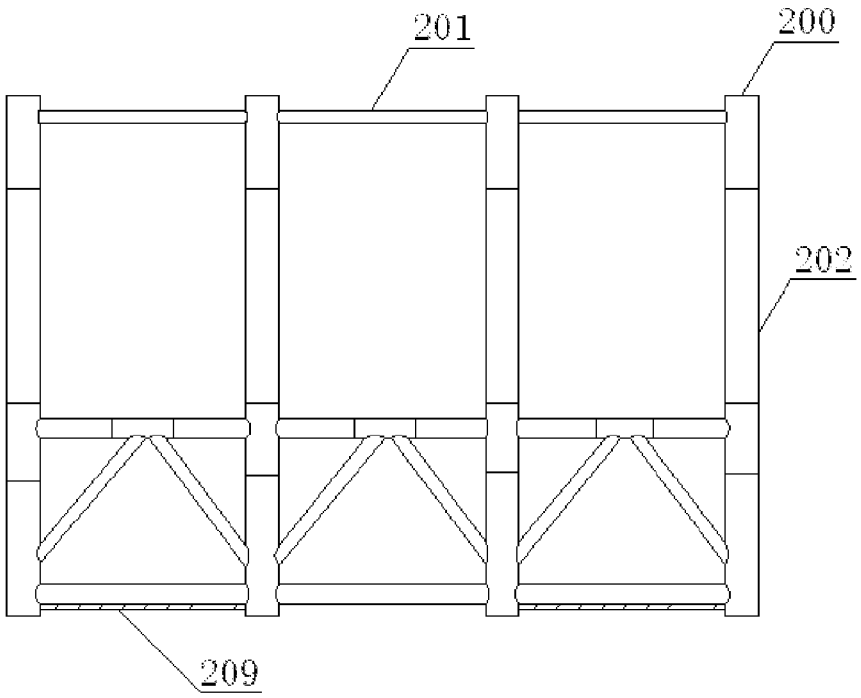
FIG. 2A is a side view of a conventional shallow water jacket with a large opening at jacket upper portion for a topsides floatover installation.
Figure 2B:
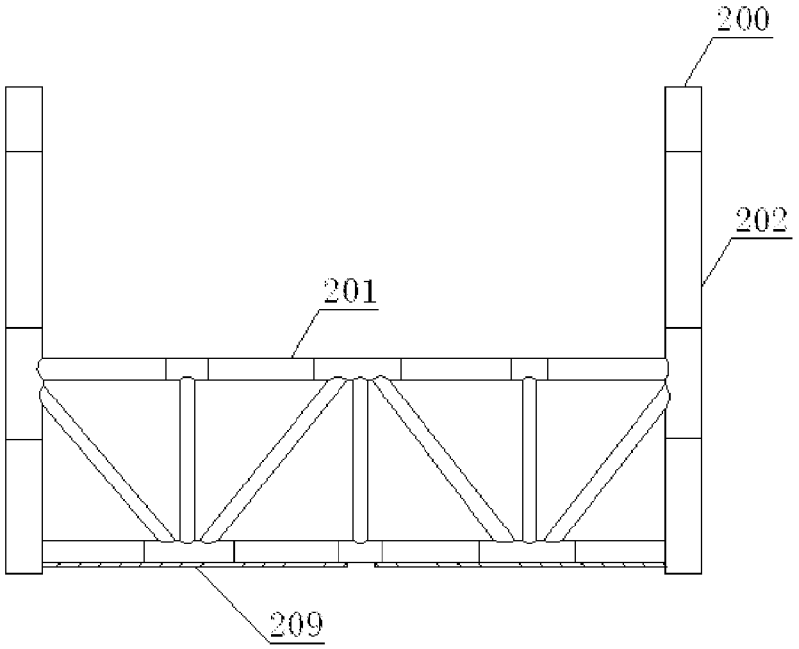
FIG. 2B is a front view of a conventional shallow water jacket with a large opening at jacket upper portion for a topsides floatover installation.
Figure 2C:
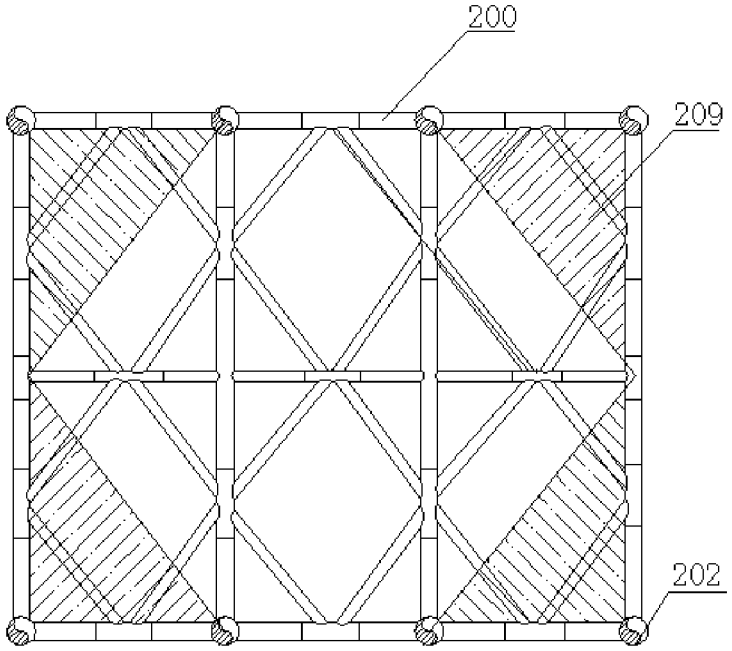
FIG. 2C is a plan section view of the bottom horizontal frame of the jacket.

This disclosure describes a method that applies SLABs 100 in offshore jacket installation. Referring now to FIGS. 2A through 2C, a shallow water jacket 200 has horizontal structural members 201 and corner main jacket legs 202. The top portion of the jacket 200 has a large opening used for deck offshore floatover installation. At the bottom layer of the jacket 200, four mud mats 209 are located.

In jacket designs, the lack of sufficient reserve buoyancy is always a big concern for all jackets. For shallow water large jacket, this concern becomes even greater. Most shallow water large jackets could not be designed to be self afloat (reserve buoyancy negative). Therefore, a large lifting capacity crane vessel is usually needed to perform the lifting operation as a part of the requirement for the offshore installation for these jackets. However, the lifting operation usually takes a majority of the jacket installation cost and the lifting operation is the only part of the jacket installation which needs a large capacity crane vessel. For all other tasks such as foundation pile installation and grouting operation, a small capacity crane vessel should suffice. Sometimes, a large capacity crane vessel may not be available locally for a large jacket offshore installation.

In order to utilize a small capacity crane vessel for the complete installation of a large shallow water jacket, the jacket has to be self afloat with positive reserve buoyancy. In this disclosure, a new type of buoyancy tanks, SLAB buoyancy tanks, is introduced to replace conventional steel buoyancy tanks because SLAB buoyancy tanks have many advantages over conventional steel buoyancy tanks:

1. More efficient in producing net buoyancy—with conventional steel buoyancy tanks each ton of steel-made buoyancy tank could produce about 2-ton of net buoyancy, whereas each ton of SLAB buoyancy tanks could produce more than 60-ton net buoyancy;

2. Easy installation and offshore removal—without welding and offshore cutting, SLAB buoyancy tanks only requires to be tied up with jacket members which make the installation and offshore removal of SLAB buoyancy tanks easy. For underwater applications, ROV (Remote Operational Vehicle) could be used to cut off the tie-up connections and recover SLAB buoyancy tanks without the assistance of divers;

3. Reusable at low cost—SLAB is designed for multiple uses. Therefore, the total cost of SLAB buoyancy tanks could be a small fraction comparing with conventional steel buoyancy tanks for jacket installation applications.

Equipped with sufficient SLAB buoyancy tanks, a large shallow water jacket could be launched in a shallow water condition and the jacket could also be transported and floated-off from the deck of a semi-submersible vessel in a shallow water location.

The key issue in applying SLABs in offshore jacket installation, especially in large shallow water jacket installation, is to develop a tie-up method between SLAB buoyancy tanks and jacket members, in which the tie-up connections should be strong enough to take potential loads such as jacket launching and these SLAB buoyancy tanks should also be easily released and recovered after an offshore jacket installation is complete.

There are two common functions for buoyancy tanks: 1) the increase of reserve buoyancy to the jacket during the jacket installation operation: 2) the increase of jacket floating stability through an enlarged water plane area of the jacket during floatation at water surface. Accordingly, two different tie-up methods are introduced in this disclosure: Type I method for Type I SLAB buoyancy tanks and Type II method for Type II SLAB buoyancy tanks. The main objective of the Type I tie-up method is to increase the reserve buoyancy of a jacket in order to make it afloat. The main objective of the Type II tie-up method is to increase the floating stability of a jacket. However, easy tie-up and offshore recovery are the basic requirements for both methods.

For Type I SLAB buoyancy tanks which aim to increase the jacket reserve buoyancy, a number of large diameter SLABs placed in a horizontal orientation, are tied-up together as a buoyancy tank group. In one embodiment, the SLABS are tied up through the "ears" at SLAB surfaces. The SLABS maybe tied up through other means. The locations of these grouped buoyancy tanks should be placed as low as possible inside a jacket bottom structure.

For Type II SLAB buoyancy tanks which aim to increase the jacket floating stability when the jacket is afloat, they are usually placed near the water suffice area along jacket corner main legs. In one embodiment, the Type II SLAB buoyancy tanks, usually placed in a vertical orientation, are tied-Lip with jacket main corner legs near the upper portion of these jacket main legs.

With ample and lower positioned reserve buoyancy for a jacket, the jacket could be launched in a shallow water condition with a vertical orientation and with a sufficient bottom clearance to seabed. This self-vertical floatation configuration in post launch condition simplifies the offshore operation and saves offshore installation time.

In additional to the launch method for a shallow water jacket described above, as semi-submersible vessel could also be used for a jacket transportation and installation. The semi-submersible vessel loaded with a shallow water jacket transports the jacket from the fabrication yard to an installation location, then submerges her deck below the water surface and the jacket then floats off the vessel deck.

Figure 3A:
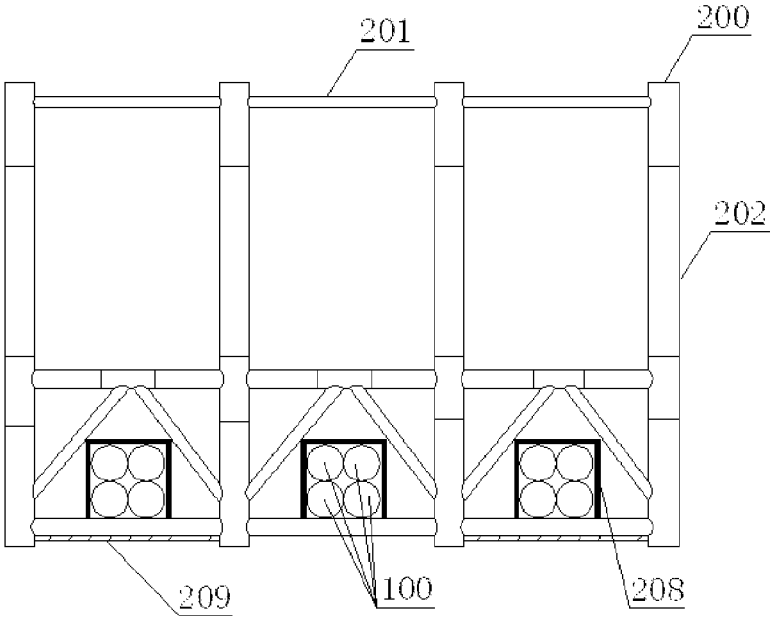
FIG. 3A is a side view of the jacket with Type I buoyancy tanks (four SLABs as a group)
Figure 3B:
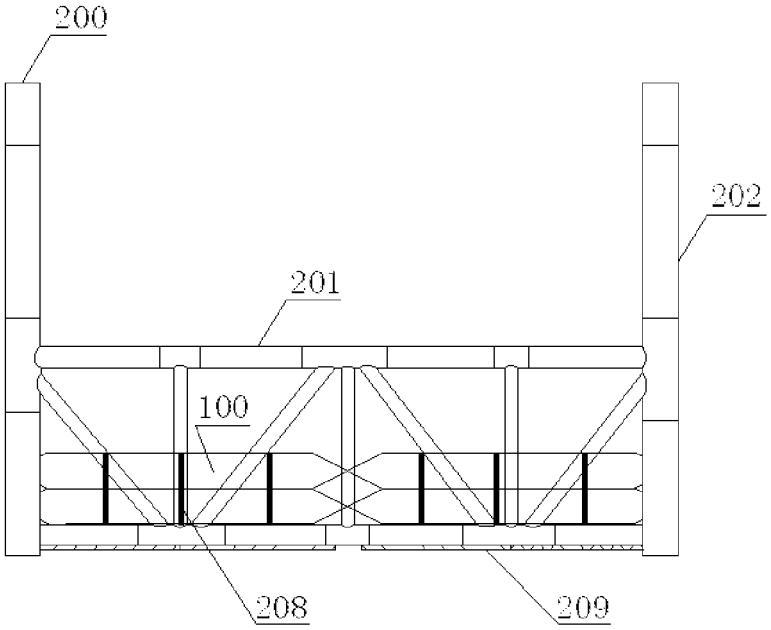
FIG. 3B is a front view of the jacket with the Type I buoyancy tanks.
Figure 4A:
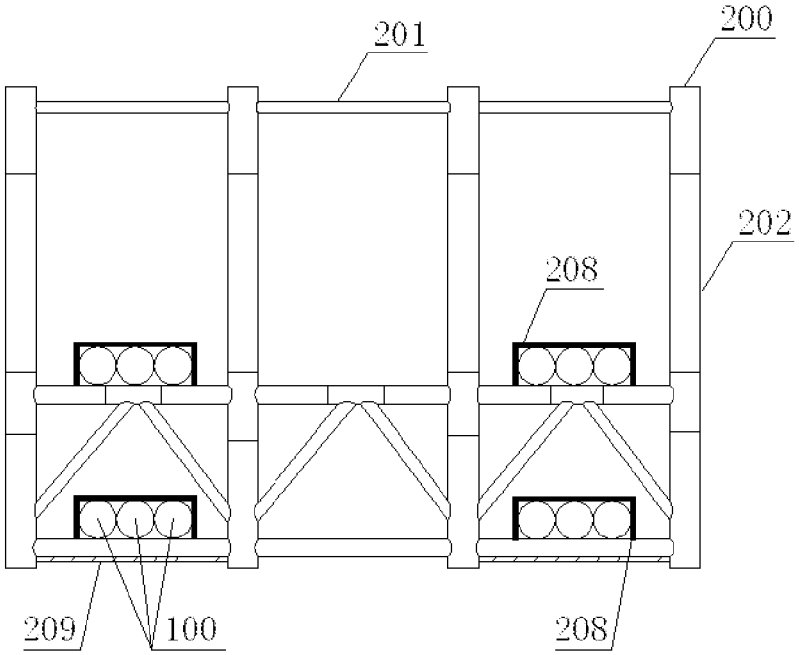
FIG. 4A is a side view of the jacket with an alternative arrangement of Type I buoyancy tanks (three SLABs as a group)
Figure 4B:
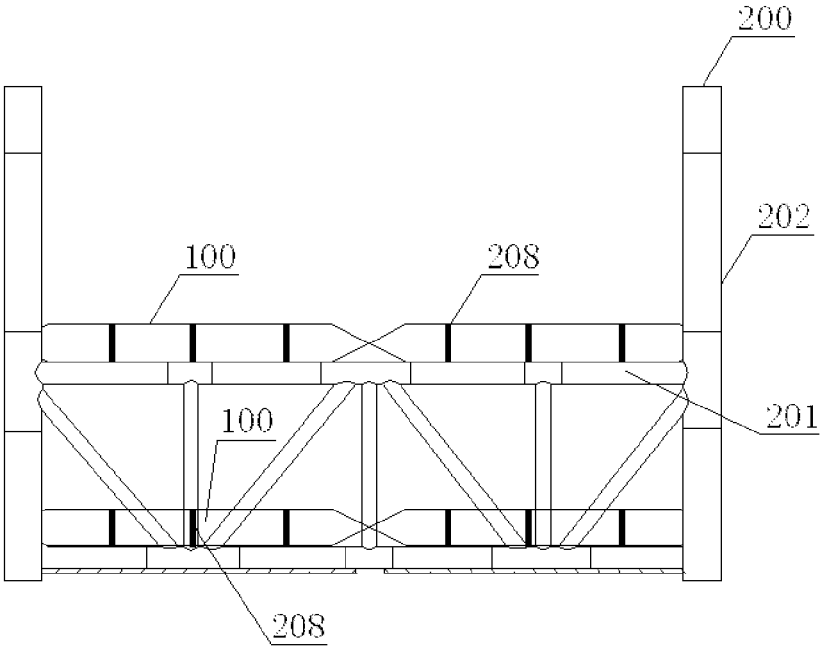
FIG. 4B is a front view of the jacket with an alternative arrangement of Type I buoyancy tanks.

Referring now to FIG. 3A and FIG. 3B, six groups of Type I SLAB 100 are located near the bottom portion of the jacket 200, in FIG. 4A and FIG. 4B, an alternative Type I SLAB application is illustrated. Each group of Type I SLAB 100 is tied-up together through ears 107 or other means. Based on the size of the each group, restrain structural members 208 are installed. Each group of SLABs 100 is in a flat condition during the installation. Once properly placed inside the restrain structural members 208, air is injected and the group of SLABs 100 is expanded and totally restrained by the restrain structural members 208. No physical tie-up between the group of SLABs 100 and the jacket 200 members is needed to form the Type I SLAB buoyancy tanks. During transportation, a pre-determined air pressure will be maintained for all SLAB 100 tanks. Once arrived at the installation site, re-injection of air to some SLAB 100 tanks should be available with a pre-installed air compressor and an associated piping system.

Once the installation of jacket 200 is completed offshore, air in each group of SLABs 100 will be released through a control center located at the top of the jacket 200. Once a group of Type I SLABS in flat condition, this group of Type I SLABs should be easily towed out from the restrain structure 208 by a tug from the side of the jacket 200 by a wire connected to rings 106 at one end of these SLABs. Air release should be controlled so that some residual air makes the SLAB group afloat and floating at water surface for easy recovery.

Figure 5A:
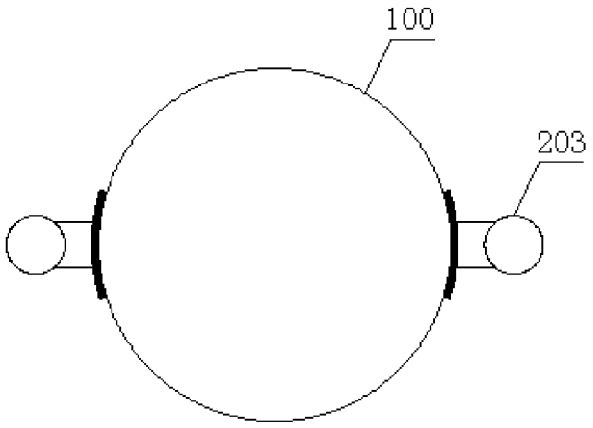
FIG. 5A is a cross section view of a single SLAB with one pair of side steel rings bonded to the SLAB middle section.

Referring now to FIG. 5A, a single SLAB 100 with a pair of side rings 203 are prepared for a Type II SLAB 100 application. The side rings 203 are totally bonded with the SLAB 100 middle section. A Type II SLAB may have multiple pairs of side rings 205 along the surface of middle section with a designed distance apart to each other.

Figure 5B:
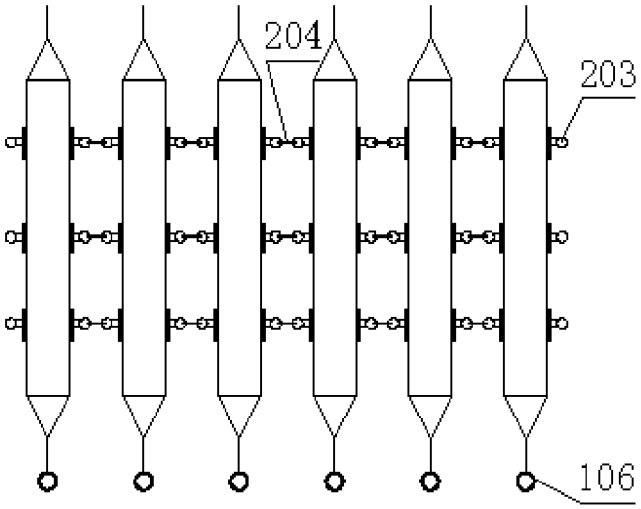
FIG. 5B is a front view of 6 single SLABs connected with side rings ready to wrap up with a jacket leg member.

Referring to FIG. 5B, six SLABs 100, each with three pair of side rings 203, are connected to form a sheet to wrap around a jacket main leg 202. The side rings 203 of the SLABs 100 are connected through a connection wire 204. The length of the connection wire 104 between adjacent SLABs 100 is specially designed so that the tightness of the SLAB 100 sheet wrapping around the jacket leg is as designed.

Figure 5C:
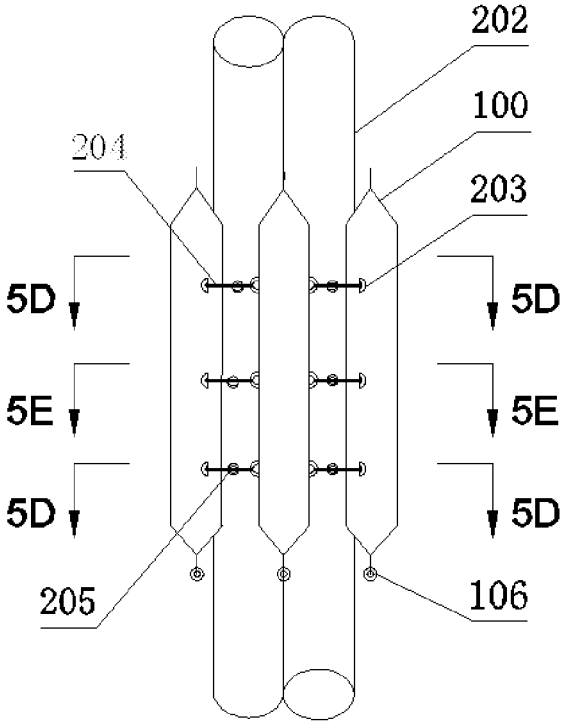
FIG. 5C is a front view of 6 single laterally connected SLABs wrapped up with a jacket leg member.

FIG. 5C illustrates one embodiment of the final installed configuration of Type II SLAB 100 buoyancy tanks. Prior to the installation, all SLABS 100 are flat and six stoppers 205 are installed at the jacket leg 202 with the same elevation as the top row of these side rings 203. Additional six stoppers 205 are also installed at the jacket leg 202 with the same elevation as the bottom row of these side rings 203 The stoppers 205 are made of steel tubular members with designed cut-off at the top to let the connection wire 204 through. The purpose of the stoppers 205 is to restrain the vertical movement of Type II SLABs 100 along the jacket leg 202 by the connection wires 204. During the installation of Type II SLAB 100 buoyancy tanks, all SLABs 100 are kept flat. After all connection wires 204 are installed and connected with associated stoppers 205, air will be injected to all SLABs 100 and these SLAB 100 buoyancy tanks are tightly wrapped around jacket legs 202. During transportation, a predetermined air pressure will be maintained for all SLAB 100 tanks. Once arrived at the installation site, re-injection of air to some tanks should be available with a pre-installed air compressor and an associated piping system.

Figure 5D:
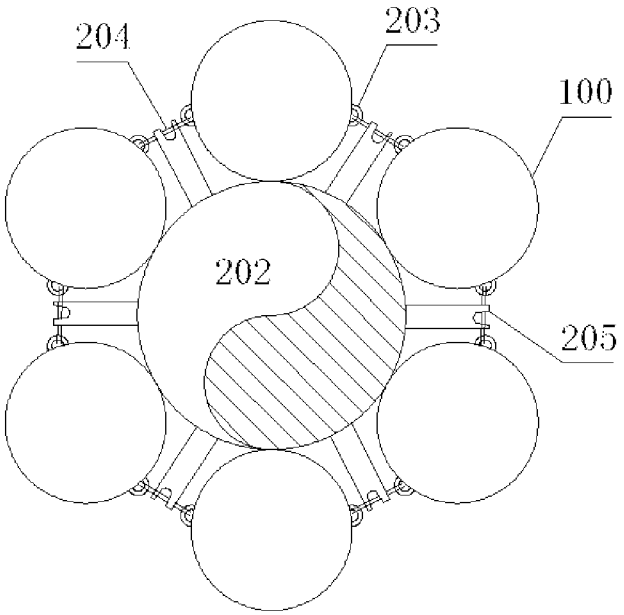
FIG. 5D is a cross section view of a Type II buoyancy tank wrapped with a jacket leg member with stoppers.
Figure 5E:
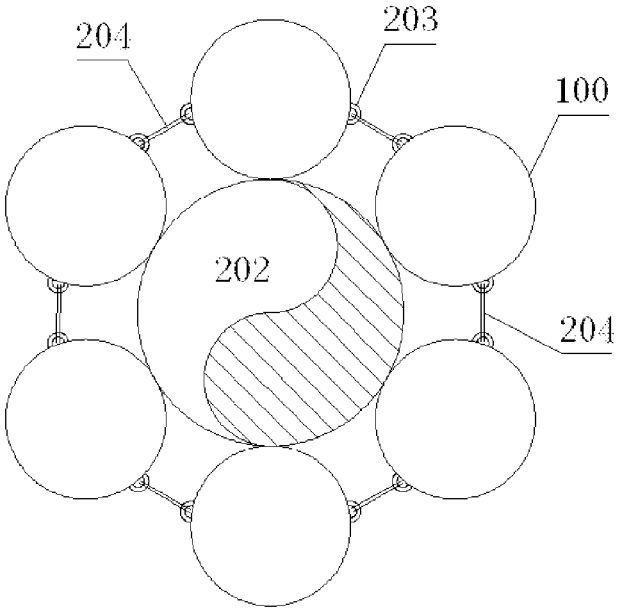
FIG. 5E is a cross section view of a Type II buoyancy tank wrapped with a jacket leg member without stoppers.

FIG. 5D shows the cross section view of the final installed Type II SLAB 100 buoyancy tanks with associated stoppers 205. As described above, the function of these stoppers 205 is to restrain the vertical movement of the SLABs 100. At the tops of the stoppers, special cutting is made to restrain vertical movement of these connection wires 204, but leave a room for Remote Operational Vehicle (ROV) under water cutting if needed. FIG. 5E shows the cross section view of the final installed Type II SLAB 100 buoyancy tanks without the associated stoppers 205.

FIG. 6A through FIG. 6D illustrate the transportation and offshore installation of a shallow water jacket, equipped with SLAB 100 buoyancy tanks, using a semi-submersible vessel.

Figure 6A:
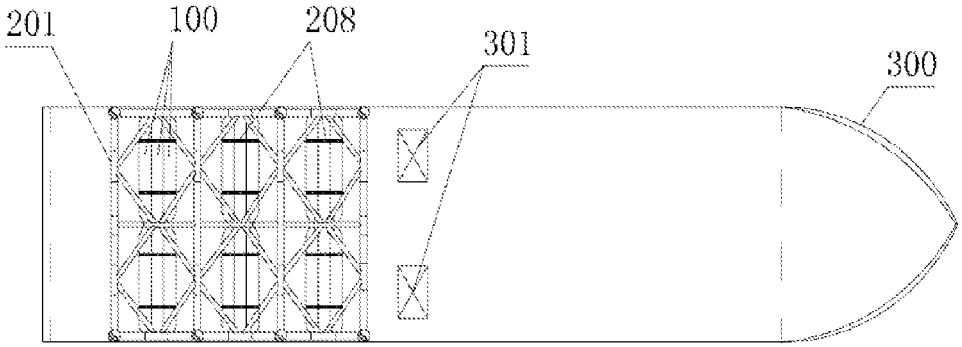
FIG. 6A is a plan view of a semi-submersible vessel loaded with a shallow water jacket installed with Type I buoyancy tanks near the stern.
Figure 6B:
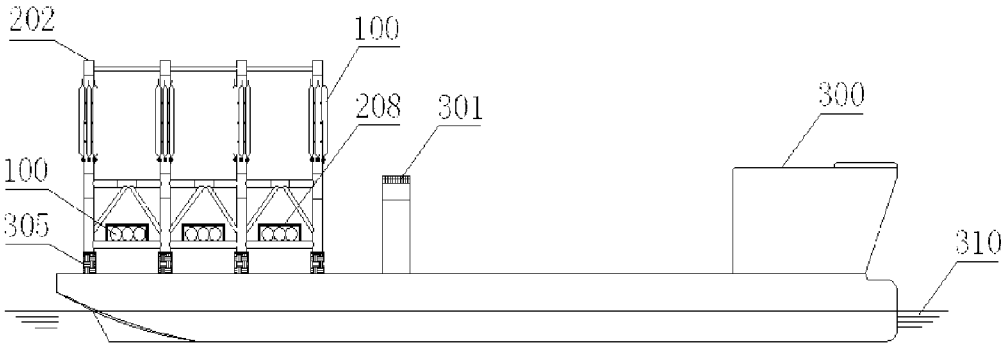
FIG. 6B is a side view of the semi-submersible vessel loaded with a shallow water jacket near the stern.
Figure 6C:
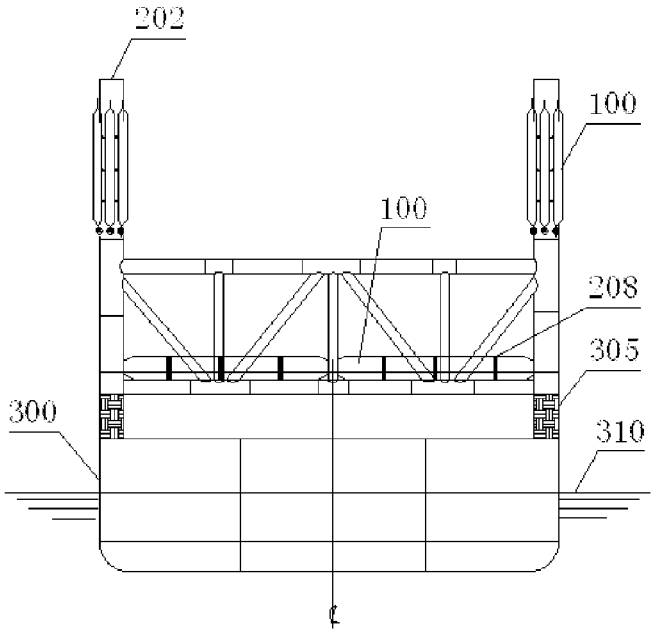
FIG. 6C is a front view of the semi-submersible vessel loaded with a shallow water jacket installed with several Type I and Type II buoyancy tanks.

Referring to FIG. 6A through FIG. 6C, a semi-submersible vessel 300 is loaded with a shallow water jacket 200 near the stern. Two stability columns 301, usually located at the stern, are relocated in front of the jacket 200. The jacket 100 sits on eight support blocks 305 plus some seafasternings during the transportation. Type I buoyancy tanks and Type II buoyancy tanks are pre-installed with a predetermined air pressure before the sail. After arrival at the installation site, air pressure inside each SLAB 100 should be readable and air maybe re-injected, if necessary, to the SLABs 100 to make their internal pressure at the predetermined pressure level. Associated equipment such as an air compressor and a piping system is needed for this air re-injection operation.

Figure 6D:
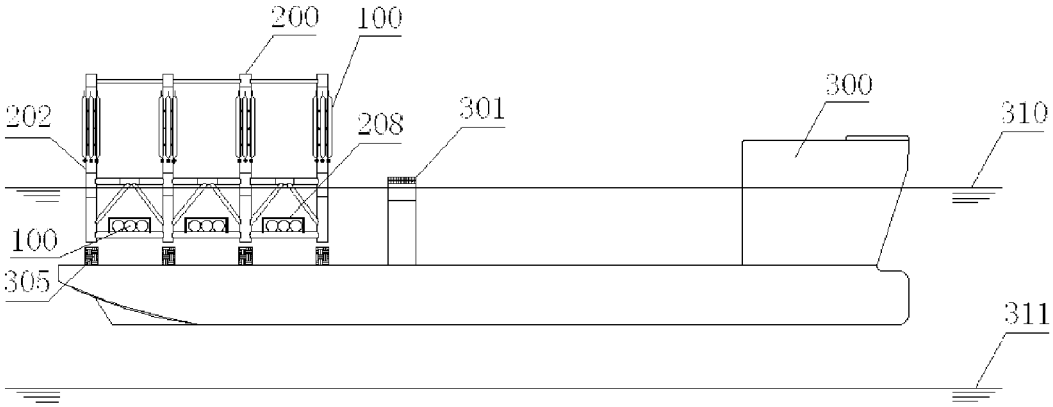
FIG. 6D is a side view of the semi-submersible vessel with vessel deck submerged below water surface and the jacket afloat and off the vessel deck.

Looking at FIG. 6D, as the deck of the semi-submersible vessel 300 is submerged under water surface 310 to a predetermined water depth, the jacket 200 becomes afloat and could be moved off the vessel 300 by pre-connected tugs 309 or a crane vessel 312 with a lifting hook 302.

Figure 7A:
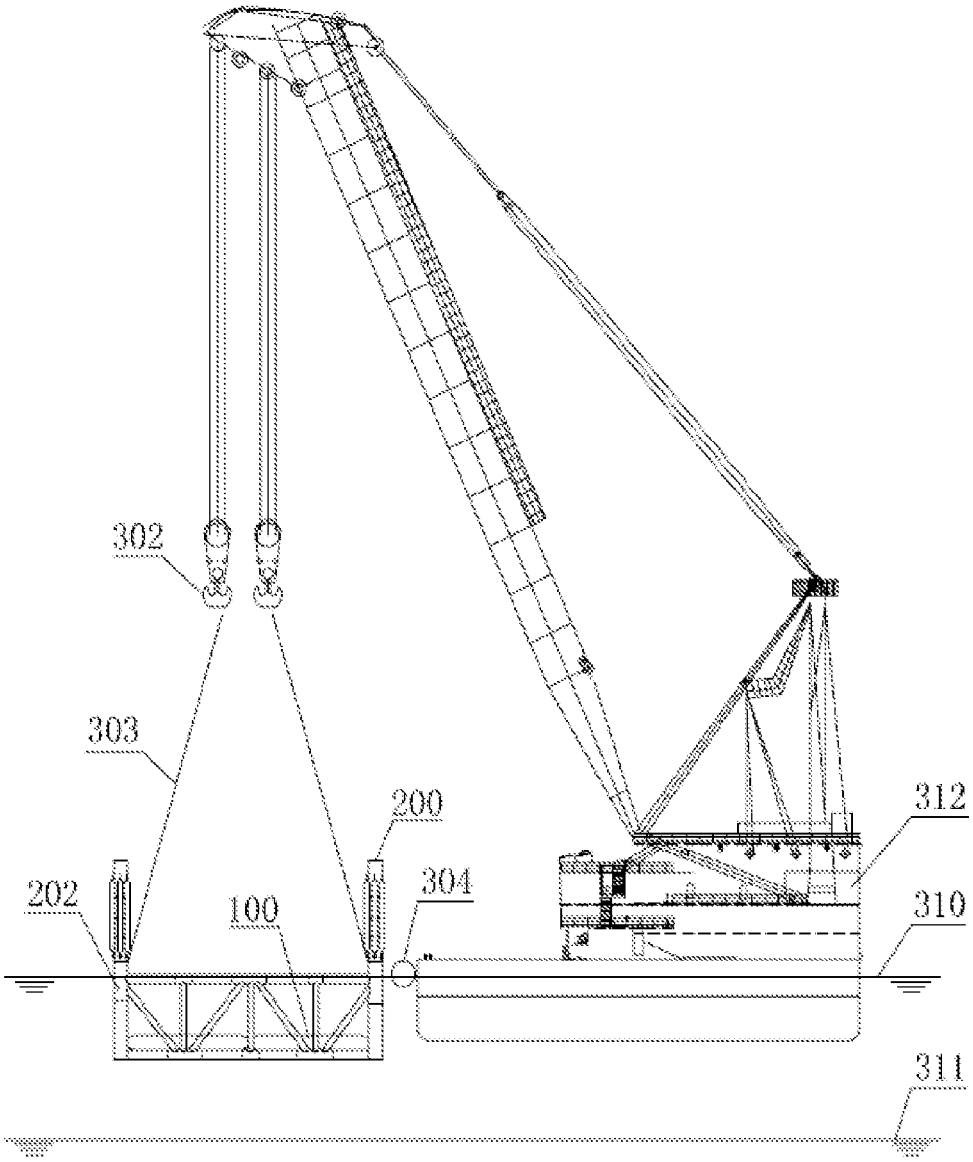
FIG. 7A is a side view of a crane vessel with an initial lift to the floating jacket at a designed hookload.
Figure 7B:
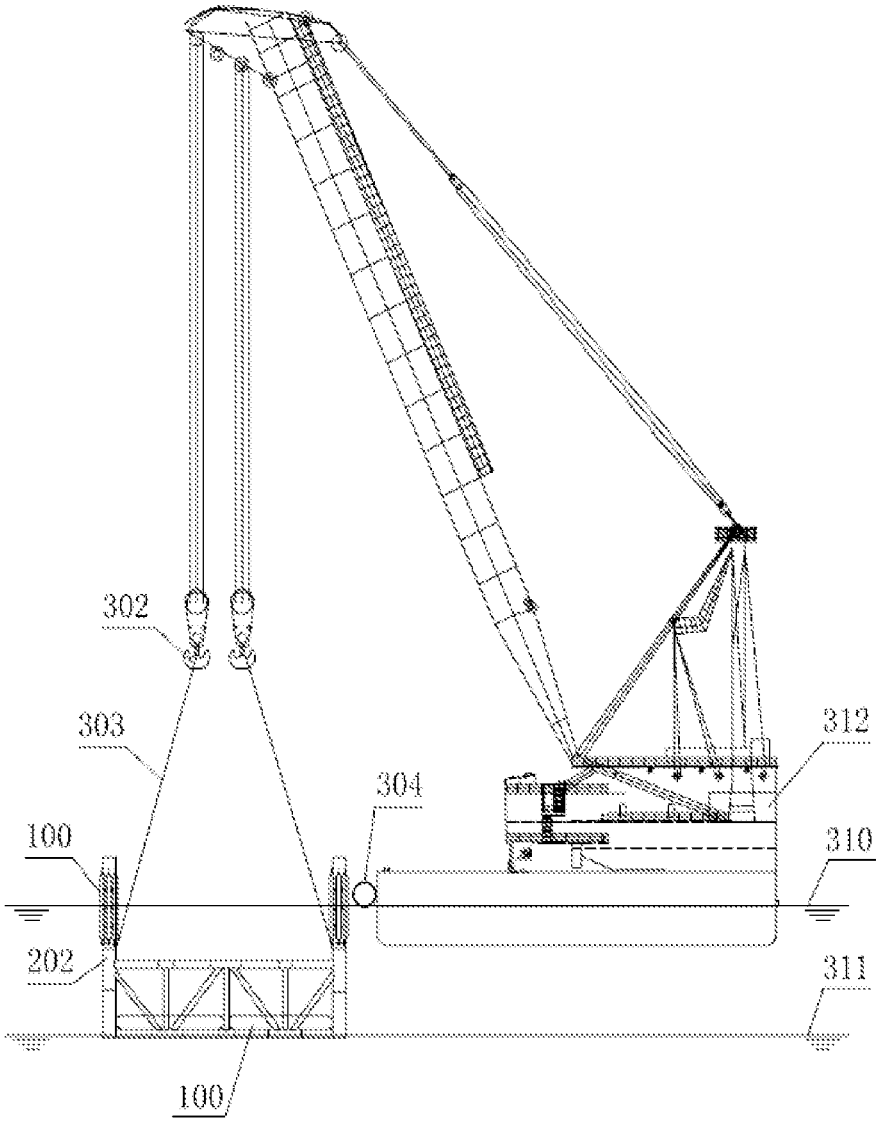
FIG. 7B is a side view of a crane vessel with lowering of the jacket at the seabed with several Type I and Type II buoyancy tanks.
Figure 7C:
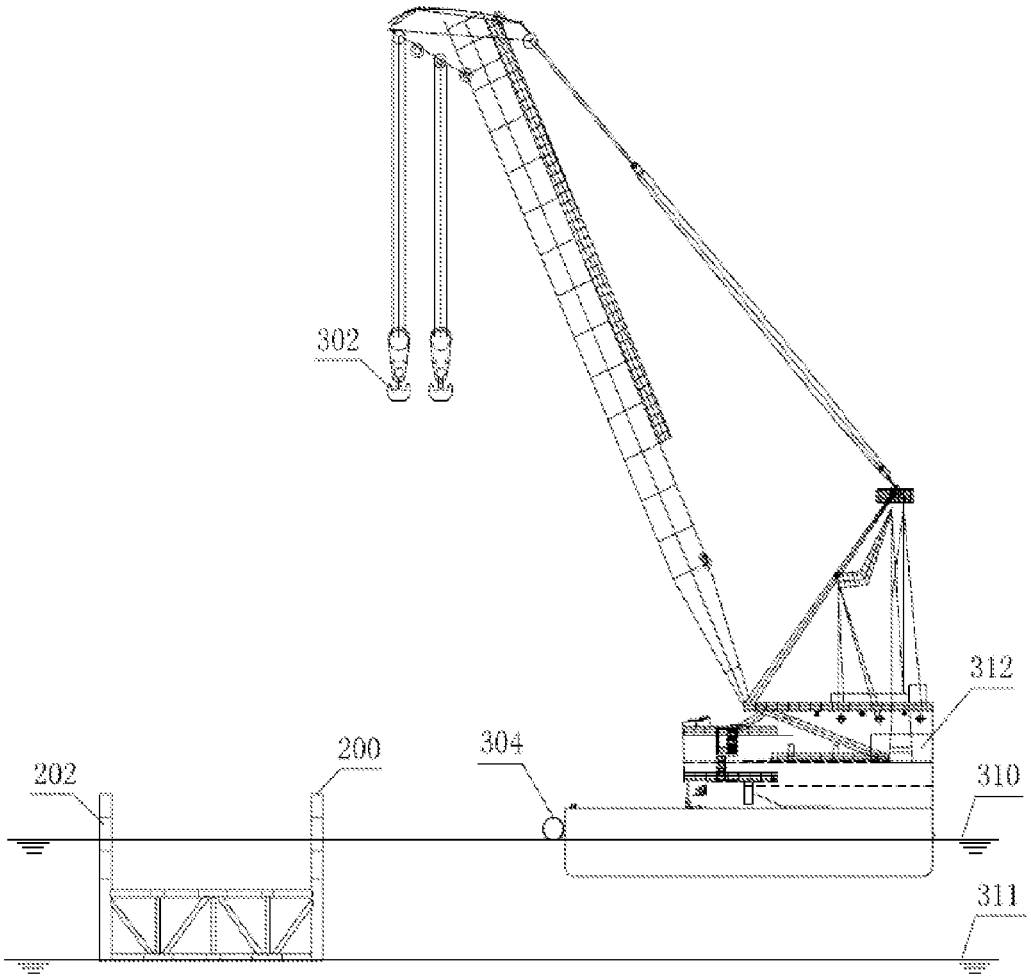
FIG. 7C is a side view of a crane vessel separated from an installed jacket after the installation is completed.

Referring to FIG. 7A through FIG. 7C, a sequence of site jacket 200 installation is illustrated. Once the crane hook 302 is connected with jacket 200 top padeyes by lifting slings 303, a hook load is applied to the jacket top in order to control the floating jacket 200 during the lowering operation.

Looking at FIG. 7B, a constant hook load is maintained during the lowering process until the jacket 200 sits on seabed 311 for remaining jacket 200 installation activities such as pile driving, grouting operation and weld-off between jacket 200 leg tops and foundation pile tops. During the time as the lowering operation, air will be released from proper SLAB 100 tanks through a control center at the jacket top to balance the required total buoyancy. During the driving piles and grouting operation period, the air pressure inside each SLAB buoyancy tanks is maintained at a designed level.

Referring to FIG. 7C, after the installation completion, air will be released from all SLAB 100 buoyancy tanks. In one embodiment, all tanks are flat. In another embodiment, all tanks are at a predetermined low air pressure in order to be afloat. For Type I buoyancy tanks, a tug 309 will be utilized to pull out each Type I tank group using a pre-installed wire set connected to SLAB rings 106. For all Type II tanks, one cutting of the connection wire 204 at middle elevation and two cuttings of the connection wires 204 at top and bottom elevations for each whole Type II SLAB 100 buoyancy tank should be sufficient to release and recover it. These recovered buoyancy tanks could be re-used for next application. When the installation is completed, the crane vessel 312 will be de-mobilized from the installation site.

Figure 8A:
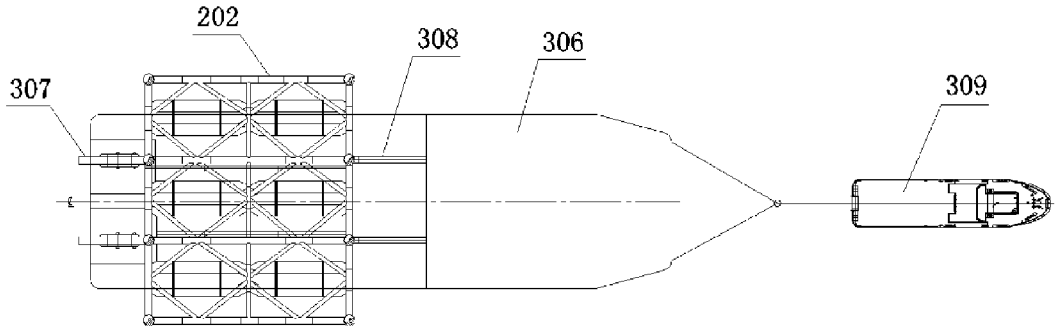
FIG. 8A is a plan view of a launch barge loaded with a jacket and several Type I and Type II buoyancy tanks near the stern of the barge.
Figure 8B:
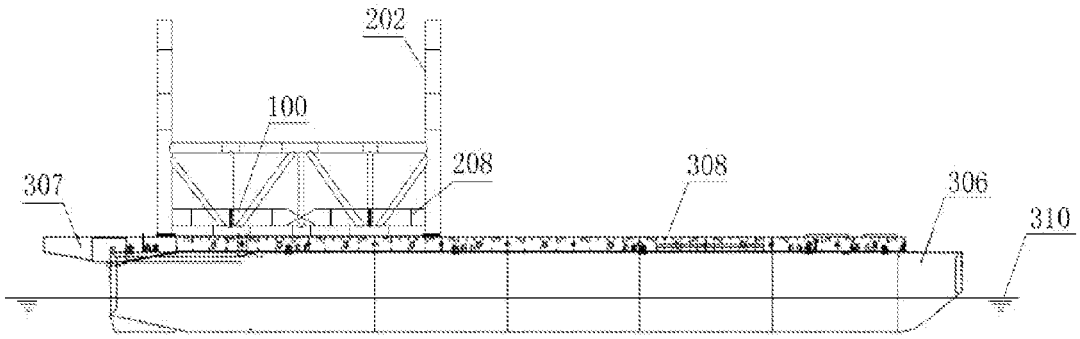
FIG. 8B is a side view of the launch barge loaded with a jacket and several Type I and Type II buoyancy tanks near the stern of the barge.
Figure 8C:
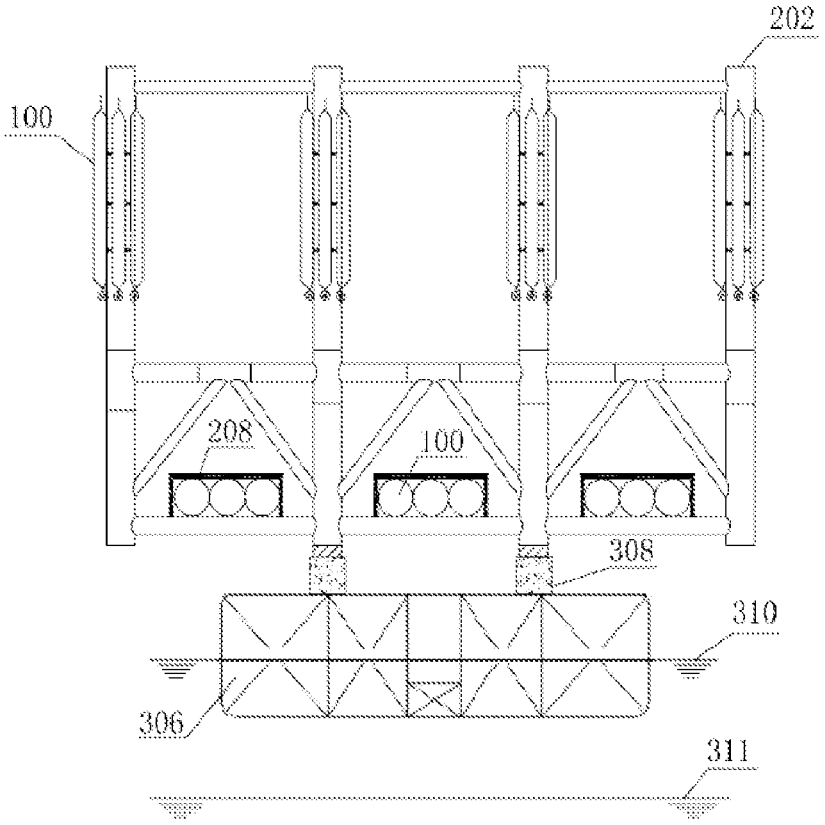
FIG. 8C is a front view of the launch barge loaded with a jacket and several Type I and Type II buoyancy tanks near the stern of the barge.

Referring to FIG. 8A through FIG. 8C, a launch barge 306, loaded with a shallow water jacket 200, is towed by a tug 309 from a jacket fabrication yard to a jacket installation site. The launch barge 306 is equipped with two rocker arms 307 and two sets of launchways 308 at barge deck surface. The jacket 200 has two matching launch cradles with the two launchways 308. Once arrived at the installation site, launch barge 306 will be ballasted down with a designed trim by the stern. Jacket 200 will be launched at a shallow water condition and the jacket 200 will be afloat in a post launch condition with a vertical orientation. The rest of the jacket 200 installation activities will be the same as described for ones using a semi-submersible 300 vessel.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A method for installing a jacket at an offshore installation site, comprising:

preparing a plurality of non-steel buoyancy tanks for the installation, wherein each buoyancy tank comprises a plurality of launching air bags, wherein the plurality of launching air bags comprise a plurality of a first type launching air bags, wherein each of the first type launching air bags has a plurality of rows of ears circularly arranged at the air bag surface, wherein the act of preparing the plurality of non-steel buoyancy tanks comprises dividing the plurality of the first type launching air bags into a plurality of groups, each group comprising two or more the first type launching air bags bonded together through the ears;

installing the prepared plurality of non-steel buoyancy tanks on the jacket;

injecting air into each of the plurality of non-steel buoyancy tanks to achieve a first predetermined internal air pressure level;

transporting the jacket to the installation site with a transportation apparatus;

removing the jacket from the transportation apparatus, wherein the jacket becomes self afloat maintaining positive reserve buoyancy after removing from the transportation apparatus;

lowering the jacket to the seabed;

releasing air from each of the plurality of non-steel buoyancy tanks to reach a second predetermined internal air pressure level; and removing the plurality of non-steel buoyancy tanks air bags from the jacket;

wherein the plurality of non-steel buoyancy tanks contribute a reserve buoyancy more than 20% of the jacket total reserve buoyancy.

2. The method according to claim further comprising releasing air from some of the air bags to reach a third predetermined internal air pressure level during the act of lowering the jacket to the seabed.

3. The method according to claim 1, further comprising reinjecting air into one or more air bags to achieve the first predetermined internal air pressure level after arrival at the installation site.

4. The method according to claim 1, wherein the act of installing the prepared plurality of non-steel buoyancy tanks on the jacket comprises placing each group of the first type launching air bags horizontally inside restrain structural members located near the bottom portion of the jacket.

5. The method according to claim 4, wherein the act of removing the plurality of non-steel buoyancy tank air bags from the jacket comprises towing out the plurality of non-steel buoyancy tanks from the restrain structures by a tug from the side of the jacket as the non-steel buoyancy tank air bags become flat.

6. The method according to claim 1, wherein the plurality of launching air bags comprise a plurality of a second type launching air bags, wherein each of the second type launching air bags has a plurality of pairs of side rings bonded at the air bag surface.

7. The method according to claim 6, wherein the act of preparing the plurality of non-steel buoyancy tanks comprises:

dividing the plurality of the second type launching air bags into groups, wherein each group has two or more launching air bags; and forming a sheet of launching bags for each group by connecting adjacent air bags through side rings of the air bags, wherein side rings are connected with a connection wire.

8. The method according to claim 7, wherein the act of installing the prepared plurality of buoyancy tanks on the jacket further comprises wrapping each sheet of launching air bags around a main leg of the jacket.

9. The method according to claim 8, wherein the act of removing the plurality of non-steel buoyancy tank air bags from the jacket comprises cutting connections wires between adjacent air bags.

10. The method according to claim 6, wherein the act of installing the prepared plurality of buoyancy tanks on the jacket further comprises:

installing a plurality of stoppers on the main leg of the jacket; and connecting the connection wires to the stoppers.

11. The method according to claim 10, wherein the act of removing the plurality of non-steel buoyancy tanks air bags from the jacket further comprises cutting connections wires connected to the stoppers.

12. The method according to claim 1, wherein the act of releasing air from air bags is conducted through a main control center above water surface.

13. The method according to claim 1, wherein the transportation apparatus is a semi-submersible vessel.

14. The method according to claim 13, wherein the act of removing the jacket from the transportation apparatus comprises removing the jacket from the semi-submersible vessel after the deck of the semi-submersible vessel submerged under water surface to a predetermined depth.

15. The method according to claim 13, wherein the act of removing the jacket from the transportation apparatus is performed by a small size installation crane vessel.

16. The method according to claim 13, wherein the act of lowering the jacket is performed by a small size installation crane vessel.

17. The method according to claim 1, wherein the transportation apparatus is a launch barge.

18. The method according to claim 17, wherein the act of removing the jacket from the transportation apparatus comprises the launching of the jacket from the launch barge.

19. The method according to claim 1, wherein the installation site is a shallow water location with a water depth less than 60 meters (200ft).

20. A method for installing a jacket at an offshore installation site, comprising:

preparing a plurality of non-steel buoyancy tanks for the installation, wherein each buoyancy tank comprises a plurality of launching air bags, wherein each air bag has a plurality of pairs of side rings bonded at the air bag surface, wherein the act of preparing the plurality of non-steel buoyancy tanks comprises dividing the plurality of the second type launching air bags into groups, wherein each group has two or more launching air bags, and forming a sheet of launching bags for each group by connecting adjacent air bags through side rings of the air bags, wherein side rings are connected with a connection wire;

installing the prepared plurality of non-steel buoyancy tanks on the jacket;

injecting air into each of the plurality of non-steel buoyancy tanks to achieve a first predetermined internal air pressure level;

transporting the jacket to the installation site with a transportation apparatus;

removing the jacket from the transportation apparatus, wherein the jacket becomes self afloat maintaining positive reserve buoyancy after removing from the transportation apparatus;

lowering the jacket to the seabed;

releasing air from each of the plurality of non-steel buoyancy tanks to reach a second predetermined internal air pressure level; and removing the plurality of non-steel buoyancy tanks air bags from the jacket;

wherein the plurality of non-steel buoyancy tanks contribute a reserve buoyancy more than 20% of the jacket total reserve buoyancy.

21. The method according to claim 20, wherein the act of installing the prepared plurality of buoyancy tanks on the jacket comprises wrapping each sheet of launching air bags around a main leg of the jacket.

22. The method according to claim 20 wherein the act of installing the prepared plurality of buoyancy tanks on the jacket further comprises:

installing a plurality of stoppers on the main leg of the jacket; and connecting the connection wires to the stoppers.

23. The method according to claim 22, wherein the act of removing the plurality of non-steel buoyancy tank air bags from the jacket comprises cutting connections wires between adjacent air bags.

24. The method according to claim 23, wherein the act of removing the plurality of non-steel buoyancy tanks air bags from the jacket further comprises cutting connections wires connected to the stoppers.

25. The method according to claim 20, further comprising releasing air from some of the air bags to reach a third predetermined internal air pressure level during the act of lowering the jacket to the seabed.

26. The method according to claim 20, further comprising reinjecting air into one or more air bags to achieve the first predetermined internal air pressure level after arrival at the installation site.

27. The method according to claim 20, wherein the plurality of launching air bags comprise a plurality of a first type launching air bags, wherein each of the first type launching air bags has a plurality of rows of ears circularly arranged at the air bag surface.

28. The method according to claim 27, wherein the act of preparing the plurality of non-steel buoyancy tanks comprises dividing the plurality of the first type launching air bags into a plurality of groups, each group comprising two or more the first type launching air bags bonded together through the ears.

29. The method according to claim 27, wherein the act of installing the prepared plurality of non-steel buoyancy tanks on the jacket comprises placing each group of the first type launching air bags horizontally inside restrain structural members located near the bottom portion of the jacket.

30. The method according to claim 29, wherein the act of removing the plurality of non-steel buoyancy tank air bags from the jacket comprises towing out the plurality of non-steel buoyancy tanks from the restrain structures by a tug from the side of the, jacket as the non-steel buoyancy tank air bags become flat.

31. The method according to claim 20, wherein the act of releasing air from air bags is conducted through a main control center above water surface.

32. The method according to claim 20, wherein the transportation apparatus is a semi-submersible vessel.

33. The method according to claim 32, wherein the act of removing the jacket from the transportation apparatus comprises removing the jacket from the semi-submersible vessel after the deck of the semi-submersible vessel submerged under water surface to a predetermined depth.

34. The method according to claim 20, wherein the transportation apparatus is a launch barge.

35. The method according to claim 34, wherein the act of removing the jacket from the transportation apparatus comprises the launching of the jacket from the launch barge.

* * * * *